US006732477B1

(12) United States Patent
Richard

(10) Patent No.: US 6,732,477 B1
(45) Date of Patent: May 11, 2004

(54) GUTTER CAP SUITABLE FOR RETROFITTING EXISTING GUTTERS

(75) Inventor: Thomas Roy Richard, Hickory, NC (US)

(73) Assignee: Rainware Holdings, LLC, Hickory, NC (US)

( * ) Notice: Subject to any disclaimer, the term of this patent is extended or adjusted under 35 U.S.C. 154(b) by 0 days.

(21) Appl. No.: 10/253,195

(22) Filed: Sep. 24, 2002

Related U.S. Application Data

(60) Provisional application No. 60/324,382, filed on Sep. 24, 2001.

(51) Int. Cl.[7] ..... E04D 13/64; E04D 13/68

(52) U.S. Cl. ..... 52/12; 52/11; 52/13; 52/15; 248/48.1

(58) Field of Search ..... 52/12, 11, 13, 52/15, 95, 94, 96; 248/48.1, 48.2; 210/474

(56) References Cited

U.S. PATENT DOCUMENTS

| | | | | | |
|---|---|---|---|---|---|
| 124,382 | A | * | 3/1872 | Perkins et al. | 52/96 |
| 1,026,085 | A | * | 5/1912 | Faupel | 52/11 |
| 2,201,504 | A | * | 5/1940 | Ruppel | 52/95 |
| 2,209,741 | A | | 7/1940 | Sullivan et al. | |
| 2,271,081 | A | | 1/1942 | Lavton | |
| 3,007,662 | A | * | 11/1961 | Featheringham | 248/48.1 |
| 3,204,375 | A | * | 9/1965 | Kotarski | 52/95 |
| 3,296,749 | A | * | 1/1967 | Cotter | 248/48.1 |
| 3,333,803 | A | * | 8/1967 | Landis | 52/12 |
| 3,444,658 | A | * | 5/1969 | Gobel | 52/96 |
| 3,550,381 | A | | 12/1970 | South | |
| 3,824,749 | A | * | 7/1974 | Scherf | 52/11 |
| 4,000,587 | A | * | 1/1977 | Weber | 52/16 |
| 4,142,370 | A | * | 3/1979 | Giordano | 405/119 |
| 4,616,450 | A | | 10/1986 | Shouse | |
| D290,224 | S | * | 6/1987 | Skinner | D8/381 |
| 4,776,544 | A | * | 10/1988 | Williams | 248/48.1 |
| 4,901,954 | A | * | 2/1990 | Fairgrieve et al. | 248/48.2 |
| 5,040,750 | A | * | 8/1991 | Brant | 248/48.2 |
| 5,092,086 | A | * | 3/1992 | Rognsvoog, Sr. | 52/12 |
| 5,169,098 | A | * | 12/1992 | Samuelson | 248/48.2 |
| 5,271,191 | A | | 12/1993 | Vahamaki | |
| 5,398,464 | A | | 3/1995 | Jacobs | |
| 5,570,860 | A | * | 11/1996 | Schoenherr | 248/48.2 |
| 5,617,678 | A | * | 4/1997 | Morandin et al. | 52/11 |
| 5,640,810 | A | | 6/1997 | Pietersen | |
| 5,845,435 | A | * | 12/1998 | Knudson | 52/11 |
| 6,101,767 | A | * | 8/2000 | Georgeau | 52/62 |
| 6,151,837 | A | | 11/2000 | Ealer, Sr. | |
| 6,543,729 | B1 | * | 4/2003 | Ylonen | 248/48.1 |

FOREIGN PATENT DOCUMENTS

| | | | | |
|---|---|---|---|---|
| JP | 153324 | * | 12/1979 | 52/12 |
| JP | 222812 | * | 8/1993 | 52/12 |
| JP | 230958 | * | 9/1993 | 52/12 |
| JP | 287865 | * | 11/1993 | 248/48.1 |
| JP | 57894 | * | 3/1994 | 248/48.2 |

* cited by examiner

*Primary Examiner*—Phi Dieu Tran A
(74) *Attorney, Agent, or Firm*—Dougherty, Clements & Hofer

(57) ABSTRACT

The invention is a gutter cap for ducting rainwater to a rainwater gutter, while simultaneously deflecting debris. The invention is particularly suitable for retrofitting pre-existing aluminum gutters. The gutter cap can be installed with minimum tools and with no disruption to the existing gutter. The gutter cap is comprised of a sloped cover, which uses the attraction of water to bend water around a hooked edge as it drains across the sloped cover and ducts it into the trough. The cover, which forms a roof over the gutter's trough, is mounted with mounting blocks that snap on the cross-struts supporting the gutter, and these mounting blocks interlocks with the hooked edge of the cover. An opposing longitudinal edge on the cover is attached to the fascia board of the roof using a few screws or nails.

2 Claims, 5 Drawing Sheets

Fig.1
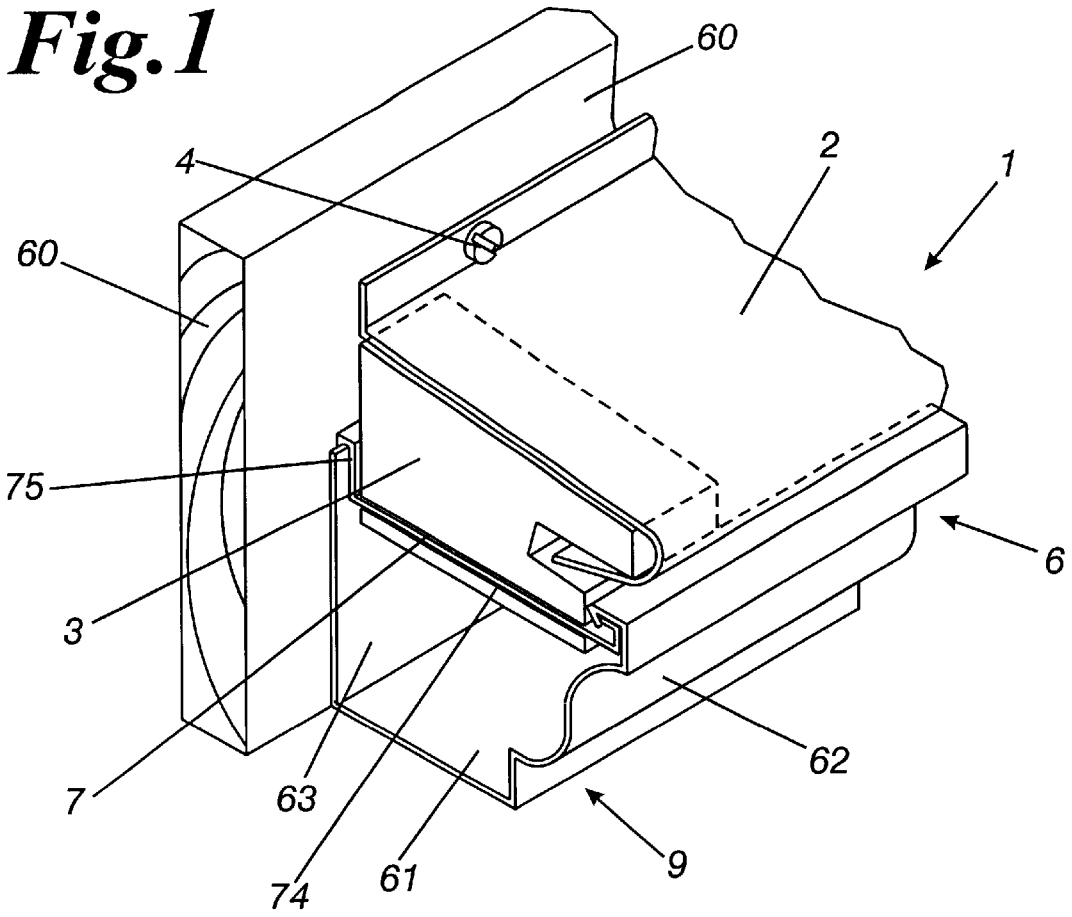
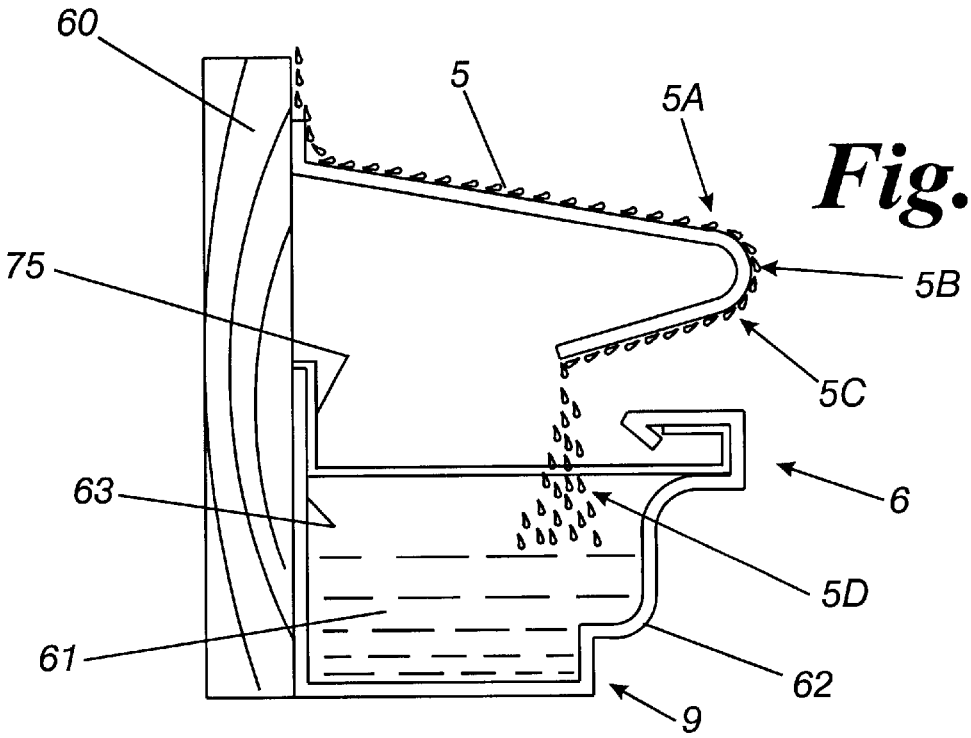
Fig.5

GUTTER CAP SUITABLE FOR RETROFITTING EXISTING GUTTERS

CROSS REFERENCE TO RELATED APPLICATION

This application claims the benefit of U.S. Provisional Application No. 60/324,382, filed Sep. 24, 2001.

FIELD OF THE INVENTION

This invention relates generally to a rain gutter, and more particularly to a rain gutter cap for equipping a new rain gutter or an existing rain gutter with a cover, wherein the cover excludes debris from entering the tough of the rain gutter.

BACKGROUND OF THE INVENTION

The literature is replete with various systems for keeping debris out of rain gutters, while allowing water to freely enter and be conveyed by the gutter.

Layton, U.S. Pat. No. 2,271,081, teaches a rain gutter comprising an "U" shaped trough member supported by hangers, and a cover. The cover (a.k.a. cap) has staggered slots or elongate apertures. The cover is held in place by pins and by nesting with a comparably hooked frontal edge of the trough member.

Ealer, Sr. U.S. Pat. No. 6,151,837, discloses a gutter screen for covering a gutter, where the gutter screen is a cover that prevents debris from falling into the gutter. The gutter screen has a frontal "V" shaped leading edge that attaches to the frontal edge of the trough, which has an inward turned lip, wherein the frontal "V" shaped leading edge receives and secures the inward turned lip. The rear edge of the gutter screen is disposed between a first course of shingles on the roof and the underlining structural roof. Rows of depressed channels are provided in the cover for directing rainwater through slots in the cover. Each channel and slot is sized so that water is directed into the channel through the slot and into the gutter, and such that debris is not trapped in the channel or the slot. There is no discussion of how the cover is supported across the width of a sectional length of cover.

Pietersen, U.S. Pat. No. 5,640,810, discloses a gutter cover for reducing the amount of debris entering a gutter. The cover is positioned over a gutter by having a rear fastenable edge that is secured between a first course of shingles and the underlining structural roof, and a frontal edge that rests upon the frontal edge of the gutter. The cover, which is comprised of an elastic material, has a thin portion, which acts as a living hinge, therein allowing the cover to pivot upwards away from the gutter frontal edge, for repair and cleaning. The cover is provided with a plurality of recessed perforations, which receive rainwater while debris washes over the cover.

Vahamaki, U.S. Pat. No. 5,271,191, teaches a gutter shield which covers and prevents debris from entering through the open top of a gutter. The gutter shield is attached to the gutter by a frontal edge, which is fastened by screws to the gutter and a rear edge flange secured between the first course of shingles and the underlining structural roof. The shield has a plurality of parallel vanes, of which each has a series of slots for receiving rainwater. The slots are sized so that debris will not pass into the gutter.

South, U.S. Pat. No. 3,550,381, teaches a perforated cover which attaches over the top of a rain gutter. The gutter is provided with frontal and rear edges (both upper and lower) having an "U" shaped channel, and periodic vertical mounting brackets having an upper downward directed "U" and a lower upward directed "U" (i.e. like a curtain rod), wherein the bracket serves as an interlocking channel to secure the back wall of the gutter. The perforated cover has an "U" shaped rear edge, and a flanged frontal edge, such that the frontal edge of the gutter receives the flange of the cover, and the upper rear edge of the gutter receives the "U" shaped rear edge of the cover, wherein the rear edge of the cover is also partially secured by the mounting bracket. There is no discussion of how the cover is supported across the width of a sectional length of cover.

Shouse, U.S. Pat. No. 4,616,450, teaches a rain gutter having a gutter shield for preventing the ingress of particulates into the gutter. The gutter shield has a solid upper surface and a generally vertical frontal surface that has a first row of rain guiding apertures and a second row of rain receiving apertures inscribed therein.

Sullivan et al., U.S. Pat. No. 2,209,741, discloses a removable screen attached over a top portion of a gutter to prevent entrance of foreign material into the gutter.

Jacobs, U.S. Pat. No. 5,398,464, discloses a gutter system having a strap for supporting a screen on the gutter. The screen allows the passage of rainwater there while preventing the entrance of foreign material into the gutter.

In general, all of the foregoing systems are designed to be installed as a complete unit, and are not suitable for retrofitting an existing rain gutter. Another characteristic is that the prior art does not disclose the use of supports across the width of a sectional length of cover. Supports add strength to long sections of cover, which can be subjected to substantial weight if debris collects on the cover. The majority of existing rain gutters are simple troughs, fabricated out of aluminum sheet metal. Each trough is reinforced with an "L" shaped cross-strut, that simultaneously braces the front wall of the trough and affixes the back wall to the eave of the roof. What is desired is a gutter cap that can be easily affixed to a new rain gutter and/or retrofitted to an existing gutter. An additional need is a gutter cover or cap that provides support widthwise for the cover.

SUMMARY OF THE INVENTION

The present invention is a gutter cap that can be facilely retrofitted to an existing rain gutter as well as a new rain gutter. The present invention is particularly suited for an aluminum sheet metal rain gutter. The gutter cap comprises a cover, a mounting block and a fastening means. The process of mounting the cover requires very few tools and substantially employs interlocking portions on the mounting block for attaching the cover to existing components of the rain gutter. The typical aluminum rain gutter is comprised of a trough having an upwardly opening mouth, at least two mounting brackets, at least two end-capping pieces, at least one downspout stream-split piece with a down spout extension, and often at least one cornering piece. The mounting bracket of a rain gutter, which is attached to a fascia plank, generally is comprised of a cross-strut for supporting a front wall of the trough and a hanging strap for supporting the back wall. In some instances the bottom of the trough is also supported. The cover is supported across the width of the opening mouth of a sectional length of cover with at least one mounting block. The cover of the gutter cap is affixed to the rain gutter utilizing snap-on hardware to connect to the cross-strut of the installed rain gutter.

The mounting block has an overall shape that defines a volume that corresponds roughly to the shape of a block "C"

or a block "O". The mounting block is comprised of a tough elastic material, and has an upper section that is a cover-interlocking portion with a frontal protrusion; a sloped upper face for supporting the cover; a lower section that is a cross-strut interlocking portion; a rear face that preferably has a recessed region for receiving a fastening element, and optionally, an extending shingle; and an undercut front face for receiving the cover.

The undercut front face corresponds to the entrance opening of the block "C". The undercut front face of the mounting block is recessed deeply enough to receive the longitudinal hooked frontal edge of the cover.

The fastening element is used to secure the mounting bracket attaching the trough to the fascia plank.

The upper horizontal surface of the cover-interlocking portion of the mounting block rests against and supports the cover. This upper horizontal surface has a downward slope coming from the rear toward the front, where the slope is substantially coextensive with the roofline. The cover-interlocking portion of the mounting block is sized such that the cover-interlocking portion can protrude into, and be received by an inner area defined by an inner surface of the longitudinal hooked frontal edge. The penetration creates a loose interlock between the longitudinal hooked frontal edge of the cover and the cover-interlocking portion of the mounting block.

The cross-strut interlocking portion of the mounting block is comprised of a tough elastic material, that has a lower section with a deformable horizontal rectangular slot for receiving and snapping onto the cross-strut, where said cross-strut spans the trough. The cross-strut, which is usually a flattened aluminum rod, has a diameter that is slightly larger than the opening of the slot, and when positioning the mounting block, the opening of the slot deforms sufficiently to enable the cross-strut to be pushed into the slot. The undeformed slot has a slightly closed opening. The slot clamps down on the cross-strut. Once positioned inside the slot, the shape of the cross-strut and the clamping slot locks the mounting block onto the cross-strut, which holds the mounting block upright. The clamping action securely fastens the mounting block to the cross-strut. The fastening element, once interposed in the recessed region, acts to support the vertical orientation of the mounting block after the block is snapped on the cross-strut. In the case where the roof shingles extend into the trough the rear face of the mounting block is recessed sufficiently to receive the extended shingles, such that after clamping the slot on the cross-strut a portion of the rear face can be in contact with a course of shingles.

The elastic material used to form the mounting block is preferably a polymeric material known to have good outside aging characteristics, such as PVC, certain grades of polypropylene, polyethylene, polyurethane, nylon and other polyamides, polyvinylidene chloride, polyester, blends of polyester, compounded natural rubber(s), synthetic rubber (s) and blends of rubber. The polymeric material can be thermoplastic, cured or uncured, and can contain fibers, fillers, microspheres, antioxidants, UV stabilizers, antimicrobial agents, and other compounding agents. Initial trials also demonstrated that cellular products including wood and foams are acceptable. The mounting block can contain voids so as to reduce material expense, as is commonly the case with extruded products.

A variation of a mounting block optimized to reduce material expense is substantially a truss shaped mounting block, wherein the truss shaped mounting block has the same functional components of a solid mounting block, albeit without the intervening material. The truss shaped mounting block has an upper section component that has a downwardly sloped upper surface that corresponds to a rafter. The rafter has a mid section, a rearward section and a forward section, wherein the forward section terminates in an inwardly curved end, which is sufficiently curved that it can be received by the longitudinal hooked frontal edge, An upper side of the rafter supports the cover. A lower section components is a cross-strut interlocking lower portion having a deformable horizontal rectangular slot, where the slot provides for receiving and snapping onto a cross-strut of the rain gutter. The lower section component corresponds to a joist. A rear face of the mounting block corresponds to a rear truss, where the rear truss emanates from the joist and supports a rearward section of the rafter, wherein the rear truss is sufficiently offset from a rear end of the joist to receive the fastening element of the mounting bracket and wherein said rear truss is appropriately angled to receive an extending shingle. A front face of the mounting block corresponds to a front truss that emanates from the joist and supports a forward end of the rafter, wherein the front truss is appropriately angled to receive the longitudinal hooked frontal edge of the cover.

The cover is substantially a flat sheet with a longitudinal hooked frontal edge, and, on the opposing edge, a longitudinal rear flange. The longitudinal hooked frontal edge curves inward and then downward, such that water flowing over the cover follows the curve of the longitudinal hooked frontal edge, and then drops off into the trough. The longitudinal hooked frontal edge can be extended to curve downward which increases drainage, thereby producing a fast flow cover. The cover has a width that is wider than the upwardly opening mouth of the trough and a length that is sufficient to provide coverage of the trough, such that when mounted over the rain gutter, the cover spans the mouth and length of the rain gutter. The longitudinal rear flange is attached to the fascia plank or secured between the first course of shingles and the underlining structural roof with the fastening means. The point of attachment is largely dependent on whether the roof shingles terminate above the mouth of the trough of the rain gutter, or the shingles extend into the trough. The length and angle of the longitudinal flange is sized appropriately for the point of attachment. When the mouth of the trough is located below the shingles, the longitudinal flange is preferably attached to the fascia plank, and the longitudinal rear flange of the cover is relatively short, 0.5 to 2.0 inches, and angled to be parallel to the fascia plank, wherein the angle of the longitudinal flange relative to the cover is 90 degrees plus the angle of slope of the cover. When the shingles extend into the mouth of the trough, the longitudinal flange is preferably attached between the course of shingles and the roof, and the longitudinal rear flange is much wider, 3.0 to 20 inches, and has a shallow angle, so as to be sloped comparably to the roofline.

The fastening means for connecting the longitudinal rear flange to the roof consists of nail(s), staple(s), screw(s), or similar fastening device(s). The cover is seated so that it slopes downward from the fascia plank or the roof toward the front wall of the trough. The longitudinal hooked frontal edge terminates inside the mouth of the trough.

The process for mounting the gutter cap is as follows. The mounting blocks are snapped-on the cross-struts by sliding the cross-strut into the slot. The slot holds the block vertically. The vertical orientation will be augmented by the interlock between the longitudinal hooked frontal edge of the cover and the cover-interlocking portion of the mounting block, where the cover-interlocking portion on the truss shaped block is the forward section terminating in an inwardly curved end. In the case of the truss mounting block, the rear end of the mounting block's rafter is seated against the roof. The cover is then aligned over the trough on the mounting blocks, and the longitudinal rear flange is attached to the roof with the fastening means. There is usually at least one fastening means for every mounting block.

The invention deflects debris and collects rainwater as follows: Rainwater coming off the roof is ducted across and down the width of the flat sheet of the cover, and flows, circumferentially, around a curved path and downward the longitudinal hooked frontal edge, and drops off into the trough; the upper surface of the cover is coated so as to be easily wetted by water, such that surface tension is sufficient so that the rainwater adheres to the surface; the rainwater's adhesion to the surface of the cover causes the water to track through an arc scribed by the longitudinal hooked frontal edge, without flying off tangentially; debris is deflected by the cover, and except for small detritus conveyed by the rainwater, debris is excluded. The surface of the cover does not have any projections onto which straw, leaves, etc; can hang up and collect and the surface does not become easily fouled.

An important feature of the invention is that if the trough needs to be cleaned, access to the trough can be gained by reversibly popping the mounting block off the cross-strut, thereby enabling the cover to be lifted.

OBJECTS OF THE INVENTION

The principal object of the invention is to provide a gutter cap that easily retrofits onto an existing gutter.

Another object of the invention is to provide a gutter cap that is easy to install on gutters where the shingles terminate in or above the mouth of the trough.

Another, more particular object of the invention, is to provide a gutter cap that excludes debris, while collecting rainwater, the gutter cap having a cover that is supported with cross-strut mounts and snap on mounting blocks.

Another object of the invention is to provide a gutter cap that is not easily subject to fouling.

A final object of the invention is to provide a gutter cap that can easily be partially detached allowing access to the trough for cleaning.

BRIEF DESCRIPTION OF THE DRAWINGS

The foregoing and other objects will become more readily apparent by referring to the following detailed description and the appended drawings in which:

FIG. 1 perspective view of the gutter cap as it is mounted on an installed aluminum sheet-metal gutter.

FIG. 5 is a side view of the cover of the gutter cap mounted on an installed aluminum sheet-metal gutter, where the view shows how rainwater is ducted into the trough.

DETAILED DESCRIPTION OF THE INVENTION

Figure 2:
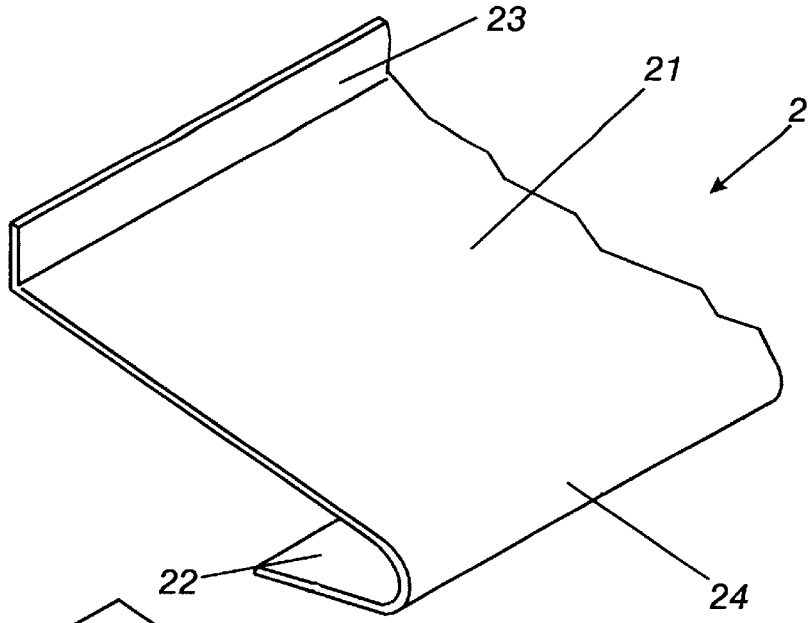
FIG. 2 is a perspective view of the cover of the gutter cap.

Referring now to the drawings, and particularly to FIG. 1, the invention is a gutter cap 1, shown in perspective in FIG. 1. The gutter cap 1 is fitted on an installed sheet-metal rain gutter 6, preferably of aluminum. The rain gutter 6 is affixed to a fascia plank 60 of an eave via a mounting bracket 7. The rain gutter as shown in FIG. 1 is comprised of a trough 9 with a front wall 62, a bottom 61 and a rear wall 63. Mounting bracket 7 reinforces the front wall 62 of the trough with a cross-strut 74 and the rear wall 63 with a hanging strap 75. The gutter cap 1 prevents leaves and other debris from entering the trough 9 of the rain gutter 6 by directing them outward, away from the trough opening.

Figure 3:
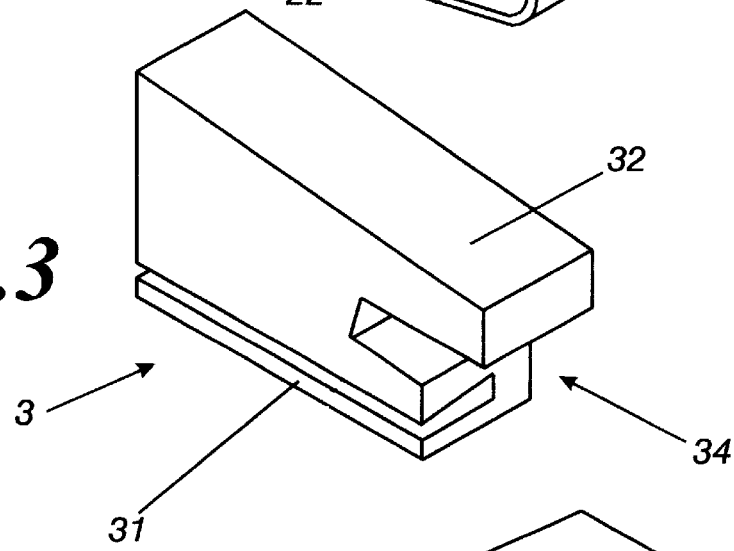
FIG. 3 is a perspective front view of a solid mounting block of the gutter cap.
Figure 4:
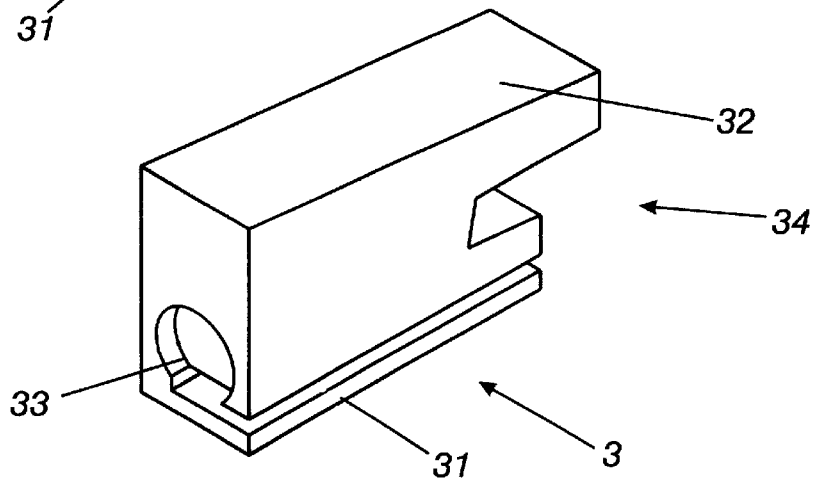
FIG. 4 is a perspective rear view of a solid mounting block of the gutter cap.

The gutter cap is comprised of a cover 2, a mounting block 3 and a fastening means 4. The fastening means 4 is a screw, which attaches the cover 2 to a fascia plank 60 of the eave. The cover 2 is supported by the mounting block 3, where an upper face of the mounting block 3 sets the pitch of the slope of the cover 2. Referring to FIG. 2, the cover 2 is a substantially flat metal sheet 21 with a longitudinal hooked frontal edge 22 and a longitudinal rear flange 23 on the opposing edge. The curvature 24 of the longitudinal hooked frontal edge 22 is approximately the reciprocal of a radius of an arc scribed by the curvature. The cover 2 has a width that is slightly wider than the mouth of the trough, and a sum of sectional lengths that is approximately the length of a sum of sectional lengths of the trough, such that when mounted over the rain gutter, said cover spans the width of the mouth of the rain gutter and the length of the trough. The cover slopes downward from the fascia plank 60 to the front wall 62. The longitudinal hooked frontal edge terminates inside the mouth of the trough 9. FIGS. 3 and 4 illustrate the mounting block 2 from to perspectives to show the features. The mounting block 2 is comprised of a tough elastic material, and has a cover-interlocking portion with a frontal protrusion and a cross-strut interlocking portion. The mounting block 2 has an overall shape that corresponds roughly to the shape of a block "C", where the cover-interlocking portion occupies an upper section of the block "C", and the cross-strut interlocking portion occupies a lower section. The segmental closure void in the block "C" corresponds to an undercut in a front face of the mounting block. The undercut in the front face is sufficiently deep to receive the longitudinal hooked frontal edge 22 of the cover 2. The mounting block has a sloped upper face 32, which supports an underside of the cover. The cross-strut interlocking lower portion has a deformable horizontal rectangular slot 31 for receiving and snapping onto the cross-strut 74, where said cross-strut 74 spans the trough. FIG. 1 shows how the cross-strut 74 fits in slot 31. The slot is slightly grooved with a recess, such that the mounting block is vertically self-aligning after forcing the cross-strut 74 into the deformable horizontal rectangular slot 31.

Referring again to FIGS. 3 and 4, the mounting block 3 also has a rear face that has a recessed region 33 for receiving fastening elements (not shown) of the hanging strap 75 of the mounting bracket 7. The hanging strap 75 (as shown in FIGS. 1 and 5) is used to support the rear wall 63 of the trough.

Figure 10:
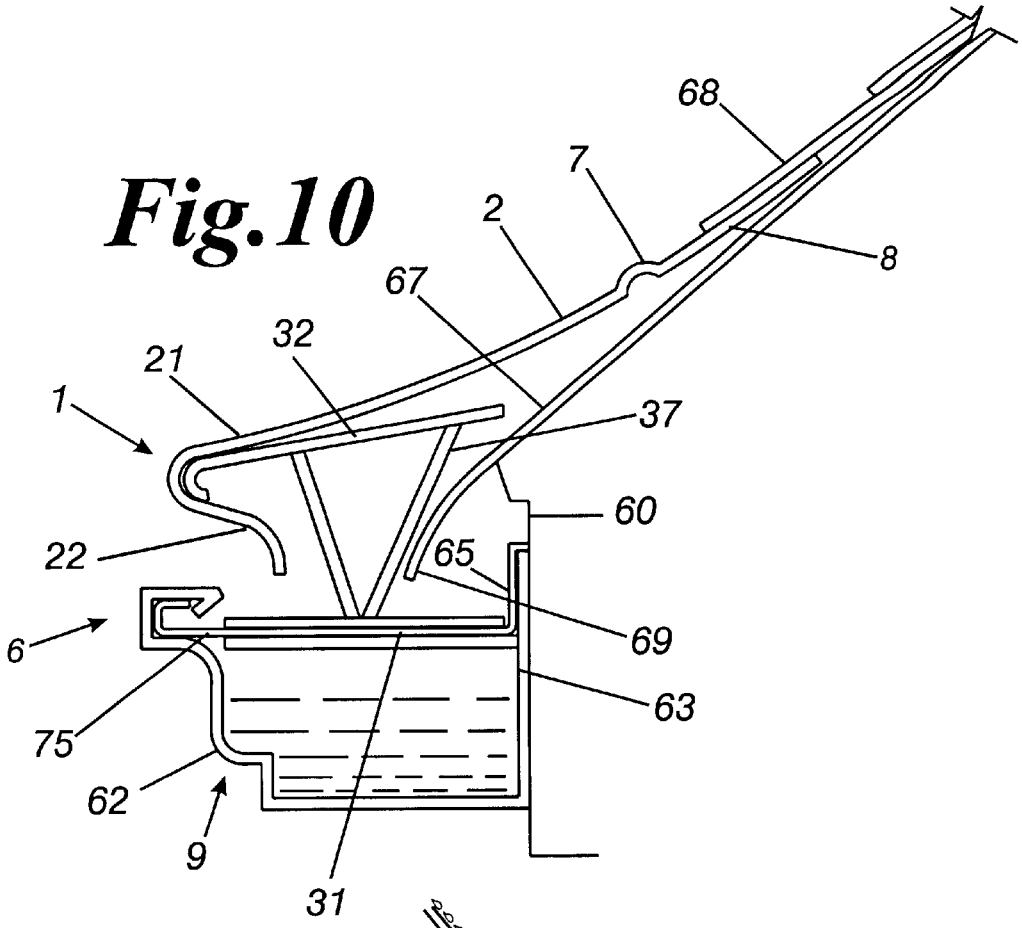
FIG. 10 is a side view of the anti-splash cover with an extended flange of the gutter cap mounted on an installed aluminum sheet-metal gutter, where the view shows how the gutter cap is installed when the shingles extend into the mouth of the trough.
Figure 11:
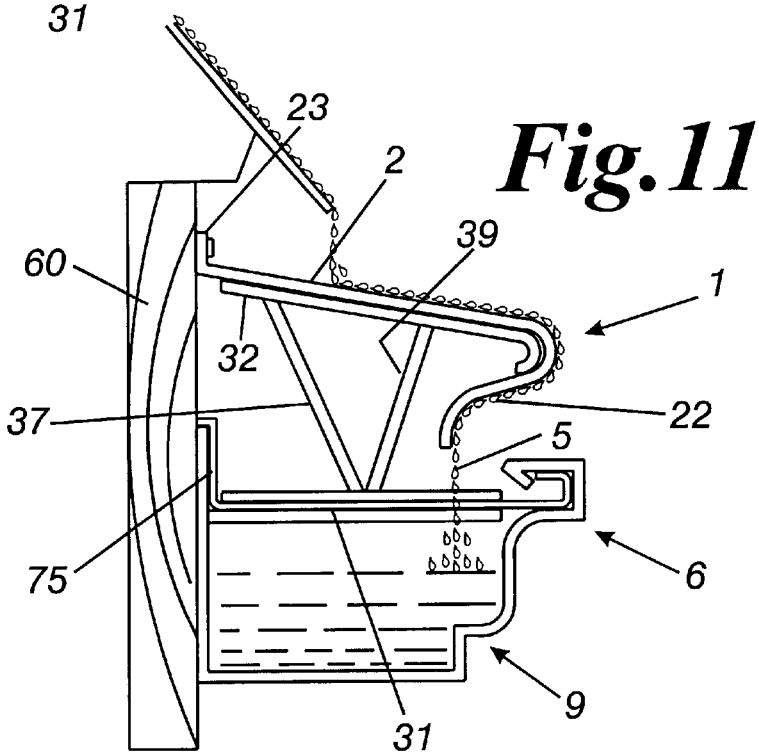
FIG. 11 is a side view of the cover of the gutter cap mounted on an installed aluminum sheet-metal gutter, were the view shows how rainwater is ducted into the trough.

The fastening means 4 fastens the longitudinal flange 23 of the gutter cap to the fascia plank 60, or to a crevice between the first course of shingles 68 (FIG. 10), and the underlying structural roof 65. The fastening means 4 consists of a screw, a staple, a nail or a similar fastener. The fastening means 4 attaches the longitudinal rear flange 23, shown in FIG. 1 of the cover 2 to the fascia plank 60 of the eave.

Figure 8:
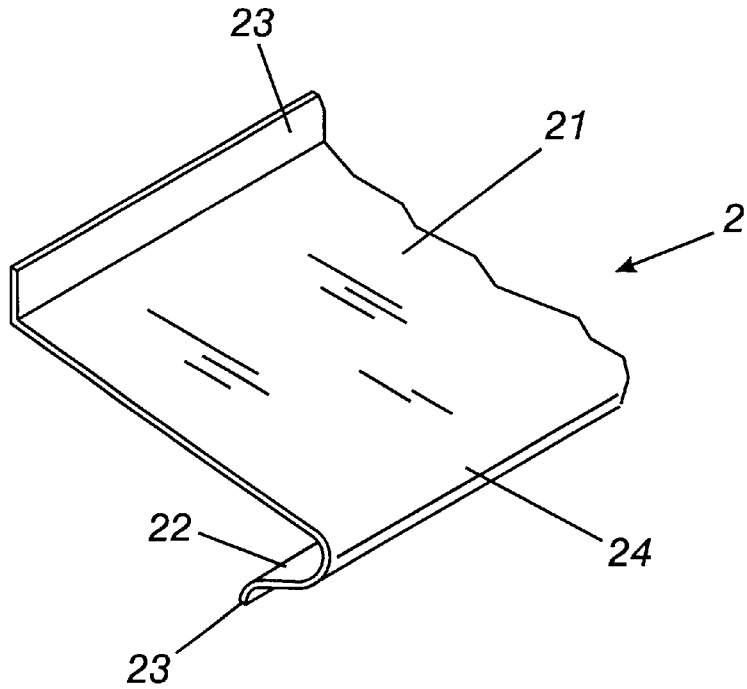
FIG. 8 is a perspective view of a fast flow cover of the gutter cap.
Figure 9:
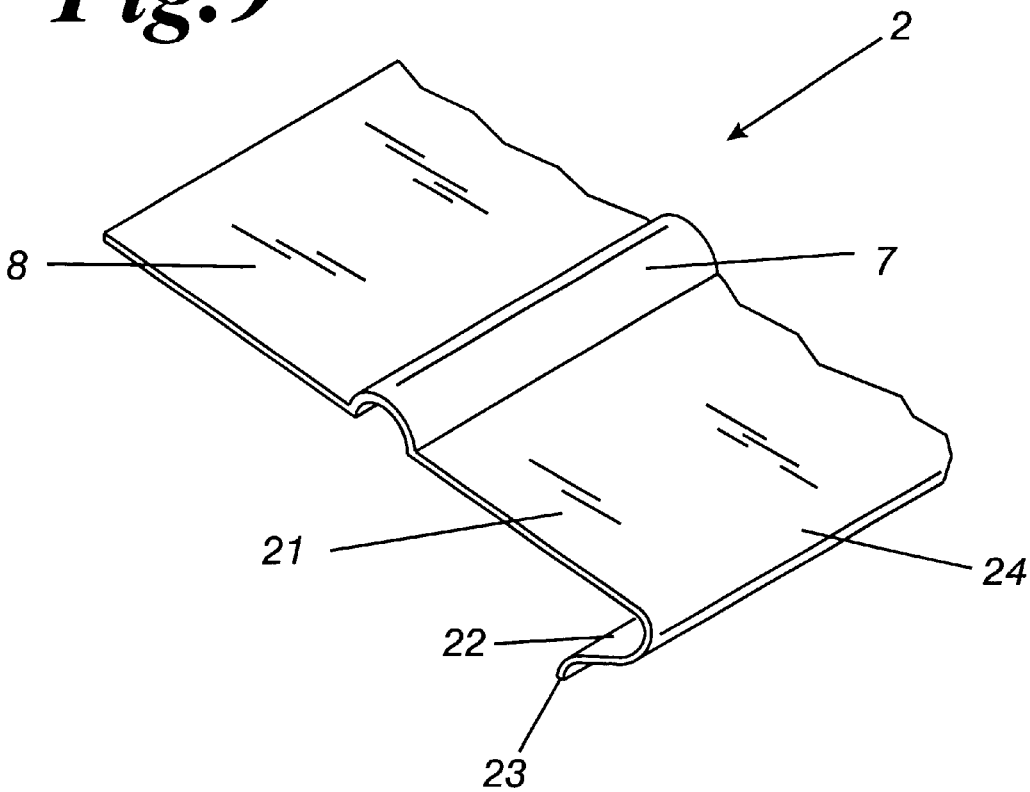
FIG. 9 is a perspective view of a fast flow cover with an extended flange.

Referring to FIG. 5, rainwater 5 coming off the roof drains across and down path 5*a*, across the width of the flat sheet 21 (FIG. 2), and flows, circumferentially, around path 5*b* and 5*c* and downward around the curvature 24 of the longitudinal hooked frontal edge 22, and drops off 5*d* into the trough 9. FIG. 8 illustrates a fast-flow cover having an extended longitudinal hooked frontal edge, wherein the frontal edge is extended, curving downward 23. The downward curve 23 increases drainage as gravity is pulling the rainwater substantially orthogonally to the wetting forces. As shown in FIG. 9, a fast-flow cover 2 having a wide longitudinal rear flange 8, is shown in perspective. The longitudinal flange 8 has a ridge 7, which adds support to the flange 8. The wide longitudinal rear flange 8 cover enables attachment to the roof under a course of shingles. This type of attachment is used when the trough is mounted such that the shingles terminate very close to or in the mouth of the gutter.

Figure 6:
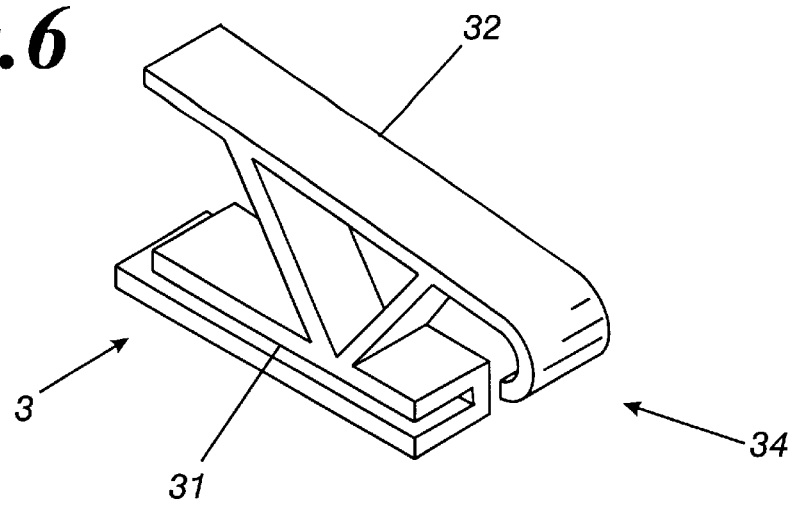
FIG. 6 is a perspective front view of a truss shaped mounting block of the gutter cap.
Figure 7:
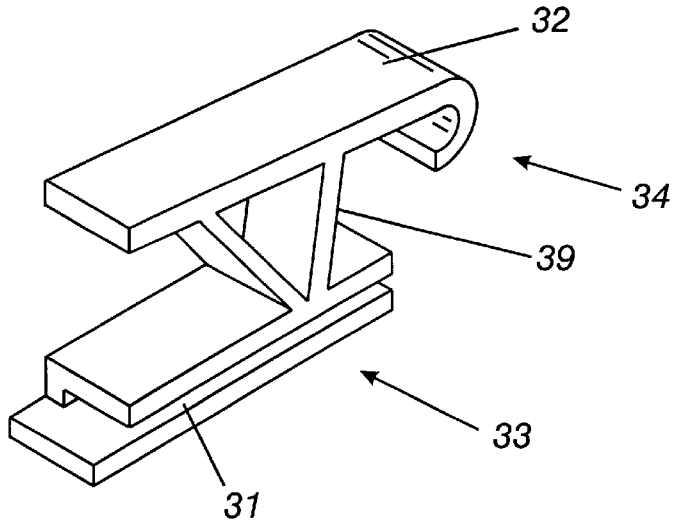
FIG. 7 is a perspective front view of a truss shaped mounting block of the gutter cap.
Figure 12:
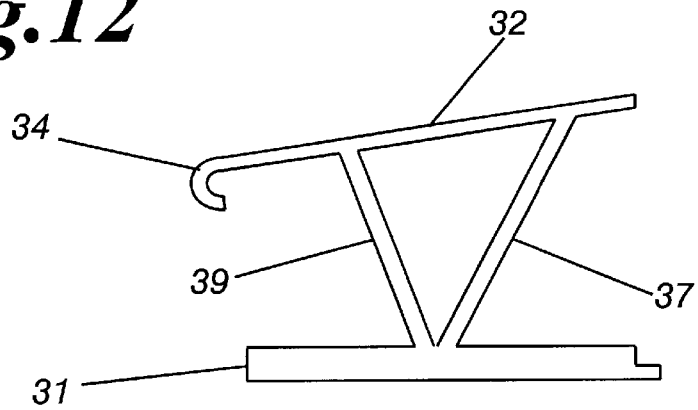
FIG. 12 is a side view of the truss shaped mounting block of the gutter cap.

A truss shaped mounting block 3 is shown in FIGS. 6, 7 and 12. FIG. 6 is a perspective front view, FIG. 7 is a perspective rear view and FIG. 12 is a side view. The truss shaped mounting block reduces material expense without reduction in functionality or performance. The truss shaped mounting block 3 has an upper section component 32 that has a downwardly sloped upper surface that corresponds to a jack rafter of a truss that terminates' in an inwardly curved end 34 which is sufficiently curved that it can be received by the longitudinal hooked frontal edge 22, wherein an upper side of the jack rafter 32 supports the cover; a lower section component 33, that is a cross-strut interlocking lower portion having a deformable horizontal rectangular slot 31 that provides for receiving and snapping onto a cross-strut 74 of the rain gutter, where the joist that corresponds to a joist 33; a functional rear face that corresponds to a rear rafter 37, where the rear rafter 37 emanates from the joist 33 and supports a rearward end of the jack rafter 32, wherein the rear rafter is sufficiently offset from a rear end of the joist 33 to receive the fastening element (not shown) of the mounting bracket and wherein said rear rafter 37 is appropriately angled to receive an extending shingle 69 (in FIG. 10); and a front face that corresponds to a front rafter 39 that emanates from the joist and supports a forward end of the jack rafter 32, wherein the front rafter is appropriately angled to receive the longitudinal hooked frontal edge 22 of the cover 2.

A truss shaped mounting block 3 is shown in FIGS. 6, 7 and 12. FIG. 6 is a perspective front view, FIG. 7 is a perspective rear view and FIG. 12 is a side view. The truss shaped mounting block reduces material expense without reduction in functionality or performance. The truss shaped mounting block 3 has an upper section component 32 that has a downwardly sloped upper surface that corresponds to a rafter of a truss that terminates in an inwardly curved end 34 which is sufficiently curved that it can be received by the longitudinal hooked frontal edge 22, wherein an upper side of the rafter 32 supports the cover; a lower section component 33, that is a cross-strut interlocking lower portion having a deformable horizontal rectangular slot 31 that provides for receiving and snapping onto a cross-strut 74 of the rain gutter, where the lower section component that corresponds to a joist 33; a functional rear face that corresponds to a rear truss 37, where the rear truss 37 emanates from the joist 33 and supports a rearward end of the rafter 32, wherein the rear truss is sufficiently offset from a rear end of the joist 33 to receive the fastening element (not shown) of the mounting bracket and wherein said rear truss 37 is appropriately angled to receive an extending shingle 69 (in FIG. 10); and a front face that corresponds to a front truss 39 that emanates from the joist and supports a forward end of the rafter 32, wherein the front truss is appropriately angled to receive the longitudinal hooked frontal edge 22 of the cover 2.

It is anticipated that individual features of the mounting block can be changed, however, with substantially no effect on the overriding functionality and operative elements. For instance the truss shaped mounting block can have intervening trusses in addition to the rear truss and the front truss. Also truss shaped mounting block can be pre-combined with the mounting bracket for easy installation of both the gutter and the cover. Likewise, the cover can be also be modified, as illustrated in the embodiments to adopt to different mounting needs, albeit also with substantially no effect on the overriding functionality and operative elements.

SUMMARY OF THE ACHIEVEMENT OF THE OBJECTS OF THE INVENTION

From the foregoing, it is readily apparent that I have invented an improved gutter cap that easily retrofits onto an existing gutter. It is easy to install, as well as a gutter cap system that excludes debris, while collecting the rainwater.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. A truss shaped mounting system for mounting a gutter cover to deflect debris from a rainwater gutter trough, the cover having a longitudinal hooked frontal edge, comprises:

a truss shaped mounting block, said block includes:

a rafter with a mid-section, a rearward section, and a forward section, the forward section terminates in an inwardly curved end that can engage the longitudinal hooked frontal edge of the cover, and wherein an upper side of the rafter is adapted to support the cover;

a joist having an elastic deformable horizontal rectangular slot;

a rear truss, the rear truss emanates from the joist and supports the rearward section of the rafter, wherein the rear truss is angled to receive an extending shingle;

a front truss emanating from the joist and supporting the forward section of the rafter, wherein the front truss is angled to receive the longitudinal hooked frontal edge of the cover; and a mounting bracket, the bracket including a cross-strut and a hanging strap, the hanging strap is adapted to fasten the bracket to a fascia, wherein a front end of the cross-strut can engage and support a front wall of the gutter trough, the hanging strap can engage and support a rear wall of the gutter trough to the fascia, and the cross-strut is inserted into the slot of the joist.

2. A truss shaped mounting system as claimed in claim 1, wherein the cross-strut of the mounting bracket is reversibly received in and detached from the slot of the block.

* * * * *